US006442896B1

(12) United States Patent
Chapin, III

(10) Patent No.: US 6,442,896 B1
(45) Date of Patent: Sep. 3, 2002

(54) MULTIPLE-AXIS HATCH ASSEMBLY

(76) Inventor: E. Barton Chapin, III, HC 33, Box 159, Bath, ME (US) 04530

( * ) Notice: Subject to any disclaimer, the term of this patent is extended or adjusted under 35 U.S.C. 154(b) by 0 days.

(21) Appl. No.: 09/564,104

(22) Filed: May 3, 2000

(51) Int. Cl.[7] ..... E05D 15/50
(52) U.S. Cl. ..... 49/193; 49/192; 52/200
(58) Field of Search ..... 49/192, 193; 52/72, 52/200

(56) References Cited

U.S. PATENT DOCUMENTS

| | | | | | |
|---|---|---|---|---|---|
| 420,541 | A | * | 2/1890 | Mallory | 49/193 |
| 1,272,594 | A | | 7/1918 | Wolter | |
| 2,261,146 | A | | 11/1941 | Dow | |
| 2,866,635 | A | * | 12/1958 | Frank | 49/192 X |
| 3,387,738 | A | | 6/1968 | Kemp | |
| 3,690,035 | A | | 9/1972 | Schindlauer | |
| 3,721,363 | A | | 3/1973 | Bressler et al. | |
| 4,532,673 | A | | 8/1985 | Kim | |
| 5,115,601 | A | * | 5/1992 | Yamaguchi et al. | 52/72 X |
| 5,704,167 | A | | 1/1998 | Swinderman | |

FOREIGN PATENT DOCUMENTS

| | | | | |
|---|---|---|---|---|
| FR | 1325321 | * | 3/1963 | 49/193 |

* cited by examiner

*Primary Examiner*—Jerry Redman
(74) *Attorney, Agent, or Firm*—Thomas L. Bohan; Patricia M. Mathers

(57) ABSTRACT

A hatch assembly in which the hatch lid can be opened along four or more axes. The hinge structure of the present invention is a continuous rod element. This rod element is integral to the frame structure of the hatch—either the hatch-lid frame or to the base frame on which the hatch lid is mounted. The hatch lid is opened by securing one side of the hatch lid to the base by engaging a pin and then applying force to the hatch-lid from direction of the enclosure. The present invention further includes an adjustable prop assembly having a support tube and an actuation rod. The actuation rod slides though the support tube and is adjustably and releasably held by a pair of mated ramped and friction blocks. These mated pairs reside on opposed sides of the actuation rod. The actuation rod has a varying diameter by which it forces the friction blocks into contact with the ramped blocks thereby locking the entire assembly. The actuation rod is moved from a locked to an unlocked position by turning the actuation rod.

31 Claims, 6 Drawing Sheets

MULTIPLE-AXIS HATCH ASSEMBLY

BACKGROUND OF THE INVENTION

1. Field of the Invention

The present invention relates to the field of ventilation of enclosures. More particularly, the present invention relates to ventilation hatch assemblies that are adapted to open on any one of a number of axes. More particularly still, the present invention relates to such a hatch assembly that can be adjustably propped open. Yet more particularly, the present invention relates to such hatch assemblies in which the hatch lid can be readily removed.

2. Description of Related Art

Often when it is desired to ventilate an enclosure, outward-opening hatch assemblies are used that are mounted on, and provide a closable opening in, a wall or the roof of the enclosure. By a "hatch assembly" it is meant a hatch lid mounted upon either a base, or a on base frame that is, in turn, mounted on a base. Unless otherwise stated, when reference is made herein to a hatch, a hatch lid is meant; a hatch assembly means a hatch lid in conjunction with a base frame. Such a hatch assembly commonly opens by the hatch lid swinging outward by means of a fixed hinge along one side of the hatch frame. This type of device is adequate if the interior of the enclosure to be ventilated is at a positive pressure compared to the outside pressure, or if the need for ventilation is slight. A better solution for ventilation is to employ a hatch assembly that can open on multiple axes, thereby taking advantage of natural forced convection due to wind that may blow from any direction. Given that these hatch assemblies are often roof-mounted and so normally horizontal when closed and, to a greater or lesser degree, vertical when open, it is also desirable to have an adjustable propping means for keeping the hatch open, so that the desired air flow is achieved.

The use of multiple axes of opening in conjunction with a door is disclosed in Wolter (U.S. Pat. No. 1,272,594; 1918) and Dow (U.S. Pat. No. 2,261,146; 1941). Both Wolter and Dow teach the use of doors that open on either of two opposed, parallel axes. Opposed, two-way opening is limiting where maximizing ventilation is desired. Further, these two devices employ hinges that are complicated and two hinges are required per opening axis. Furthermore, these devices lack an adjustable means of securing the door in an open position.

Kim (U.S. Pat. No. 4,532,673; 1985) discloses a window that opens on up to three independent axes working in conjunction with an array of actuator rods. Because there is no configuration of the actuator rods in which none of the axes are engaged the Kim device lacks the ability to easily disengage and remove the window short of disassembly. Furthermore, the Kim device employs complicated hinges, two being required per opening axis.

The device of Schindlauer (U.S. Pat. No. 3,690,035; 1972) provides the ability to open a window along any one of four different axes. However the device of Schindlauer is complex and requires electric motors for selectively activating hinges of the desired axis of opening. And as with the earlier cited devices, Schindlauer operates with a plurality of hinges per opening axis.

Also teaching devices with more than three axes are Bressler (U.S. Pat. No. 3,721,363; 1973) and Kemp (U.S. Pat. No. 3,387,738; 1965). Both Bressler and Kemp disclose hatch assemblies used in conjunction with pressure vessels. These hatch assemblies are inherently limited by their structure (i.e., the structural requirements of high pressure vessels) to only sealing when the interior volume of their respective pressure vessels are subjected to pressurization. Additionally, the devices of Bressler and Kemp are operated from the outside of the enclosure, where hatches for ventilation and egress need to be operatable from within. Swinderman (U.S. Pat. No. 5,704,167; 1998) discloses a door with four axes of opening. However, the Swinderman door requires a three-part hinge and possesses an inherent lack of ability to seal against inclement weather. Additionally, the Swinderman device lacks any means for varying the degree to which the door is held open.

Therefore, what is needed is a manually operated device that can be selectively opened on any one of a plurality of axes. What is further needed is such a device that can be readily removed for ingress and/or egress during an emergency. What is yet further needed is such a device that can be effectively sealed against inclement weather. What is still yet further needed is such a device that can be locked from within the enclosure which it is used to ventilate, so as to prevent ingress. What is still yet further needed is such a device that employs hinges made from few parts, and is in other ways is mechanically simple so as to be easily manufactured. Finally, what is still yet further needed is such a device that can be easily opened and held open to an adjustable degree from within the enclosure which it is used to provide access or ventilation.

SUMMARY OF THE INVENTION

The present invention includes a hatch assembly that can be selectively opened along one of a number of different axes according to its user's desire for airflow into an enclosure on which the device is mounted. In addition, the present invention includes an adjustable prop-assembly which holds the hatch lid open—i.e., so that the hatch lid and a plane containing the base frame aperture form dihedral angles of varying degrees—to any desired degree of opening. The enclosure will often be an interior volume of a yacht or a motor home. However, this enclosure could also be an automobile, a building, or any other volume for which ventilation is desired. In one roof-mounted embodiment, the hatch assembly of present invention can be visualized as being somewhat like a common skylight with a hinge along each of its edges.

The hatch assembly, in its most basic form, consists of a hatch lid (including a hatch-lid frame and a hatch-lid deck), a base, a rod element, a plurality of removably engageable pins, and an optional prop mechanism. The hatch-lid is mounted to the base, surrounding an opening through an enclosing surface of the enclosure. The "base" may be either integral to the surface of the enclosure surrounding the opening or, alternately, a separate base frame mounted to that surface around that opening. "Base frame" will refer to either alternative. Where desirable, a seal, gasket, weather stripping, may be provided to make the hatch assembly weather, water, or air tight.

A continuous peripheral rod element acts as the means of communication between the hatch lid and the base frame, and the plurality of removably engagable pins are provided for engaging the rod element. The rod-element has a predetermined number of straight segments corresponding to the number of straight sides of the perimeter of the hatch lid and base frame, and each straight segment is able to act as an axis of opening for the hatch. The hatch lid and base frame can have the shape of any geometric figure having as many straight sides as there are desired axes of opening— e.g., square for a four-way-opening hatch assembly, hexagonal for a six-way-opening hatch assembly, and so forth. The shape need not be regular or symmetrical, and it need not conform to the shape of the opening, but only need surround it. The rod element can be fixed to either the hatch lid or the base frame, conforming to the geometric perimeter of the hatch lid and base frame. Thus, the rod element is integral with one component, hatch lid or base frame, and received by the other in a groove or channel conforming to and made to receive the rod-element. In either case, the straight segments of the rod element between the hatch-lid and the base frame act as the hinge pins of the hinges about which the hatch lid pivots; the confining components of the hinges, in which the hinge pins rotate, are provided by the removably engageable pins.

The hatch lid, in its most basic form, consists of a generally flat hatch-lid deck made of a plate-like material fitted within a hatch-lid frame. Where a roof-mounted hatch may be walked on or have to support weight, the hatch-lid deck will be made from a suitably strong material, such as wood, plastic, or metal, and may be provided with a non-skid upper surface. Also, where it is desirable to admit light or permit visibility through the closed hatch, the hatch-lid deck material may be translucent or transparent.

To open the hatch along a particular axis of opening, a user positions one of the plurality of pins to engage the appropriate straight segment of the rod element, disengages or removes all remaining pins from all the remaining straight segments of the rod element, then pushes the hatch-lid open. Because only one straight segment of the rod element along one common side of the hatch lid and base frame is restrained, and the other sides of the hatch lid and base frame are unrestrained, the hatch lid pivots open about the selected axis. Being integral to the structure of the hatch—either the base frame or hatch-lid frame—the rod element, in combination with the pins, provides the present invention with a simple multi-axis hinge mechanism, one requiring only a pin to complete the hinge mechanism on any desired axis. Furthermore, the simple, disengagable hinges thus formed also allow the hatch lid to be easily uncoupled and removed from the base frame, simply by disengaging or removing all the pins at once. and the prop support pins. Conversely, the same simple multi-axis hinge mechanism also acts as a means of locking the hatch assembly simply by engaging all, or at least two or more, of the pins at the same time. Still further, the all or any of the mechanically simple functions of hinging, uncoupling, and locking the hatch assemble are easily and equally operatable by manual, mechanical, electromechanical, pneumatic, or any other well-known means of actuation and manipulation.

In order to maximize ventilation according to the user's preference, and in general, to take advantage of the wind direction and wind speed, the hatch lid may be held open to varying degrees by an adjustable prop assembly. The present invention is not limited to providing ventilation, and may simultaneously provide a closure for a means of ingress and egress, so that the prop assembly is also removable. The adjustable, removable prop assembly consists of a support tube and an actuation rod. The support tube adjustably engages the actuator rod by suitable means, including ramped blocks, screw clamps, or any other suitably adjustable engagement means, so that the actuator rod can be held secure at any point as it slides through or along the support tube.

One end of the actuator rod is attached to the hatch lid. The attachment may be fixed or removable, depending on the desired use of the hatch assembly. The other end of the actuator rod may have a handle by which the actuator rod may be pushed or pulled through or along the support tube, in order to open or close the hatch lid, by which the actuator rod may be turned and otherwise manipulated, and the manipulations of which may also be used to engage the adjustable engagement means and secure the hatch lid in the desired position. The ends of the support tube are removably attached to opposite sides or corners of the base frame, so that the support tube spans the opening and can be removed separately from or along with the hatch lid. The actuator rod and/or the support tube are hinged in a manner that allows the actuator rod to assume any angle with respect to the hatch opening and hatch lid and provide support and stabilization of the hatch lid.

DETAILED DESCRIPTION OF THE PREFERRED EMBODIMENT

The present invention is depicted in FIGS. 1–8. In reference to FIGS. 1–3, a rectangular hatch assembly 100 is adapted to be attached over a rectangular opening in a base member 12 by means of a base frame 11. The base member 12 can be a partition, or a ceiling, roof, bulkhead, wall, or other such structural part of an enclosure. The base frame 11 of the hatch assembly 100 is attached to the base member 12 in a manner similar to the installation of a typical skylight or any other manner consistent with good construction.

Figure 1:
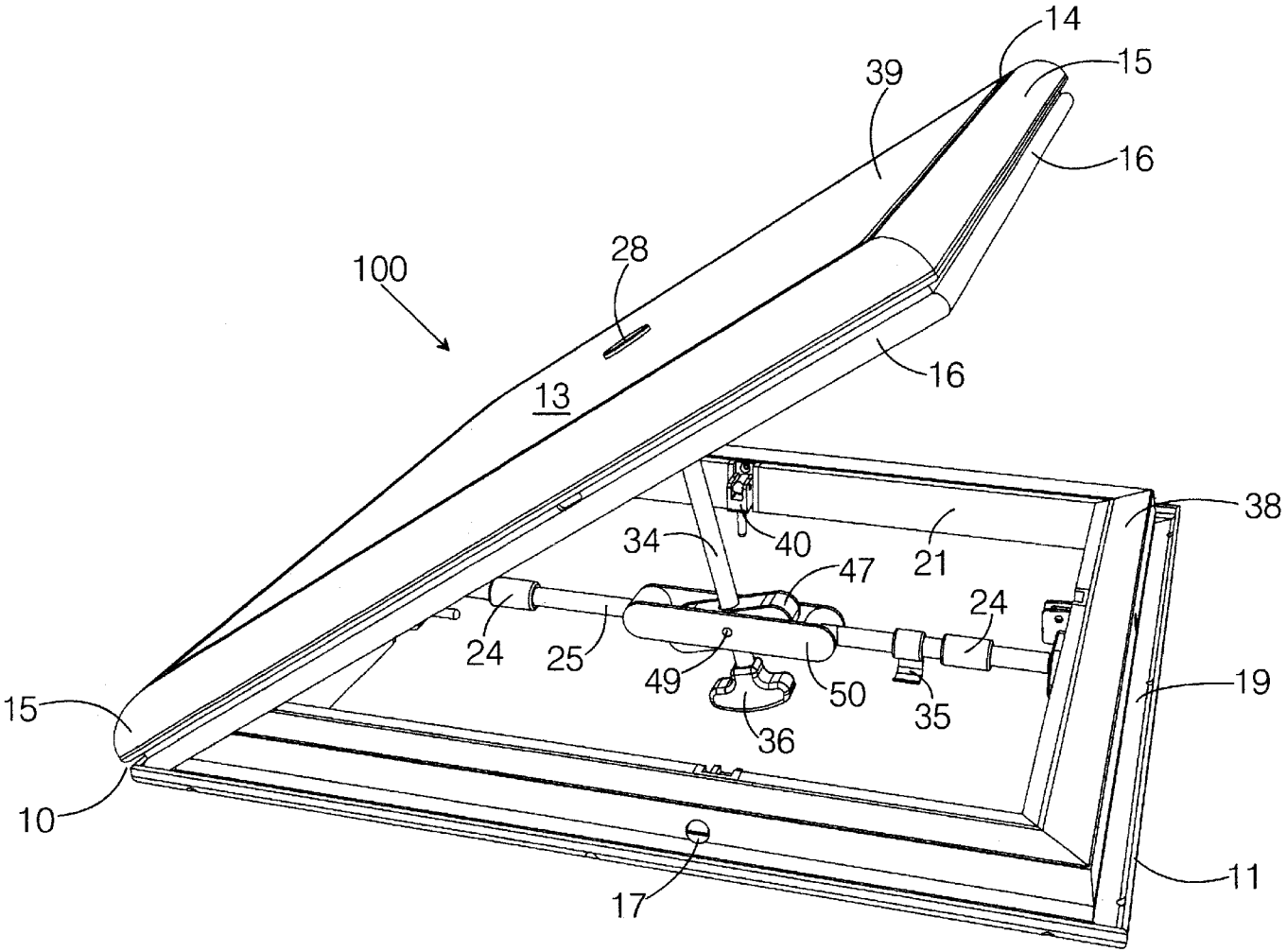
FIG. 1 is a perspective view of the Preferred Embodiment of the present invention, hinged open along one of its axes.

In FIG. 1, a hatch lid 39 is shown in an open position. The hatch lid 39 consists of a hatch-lid frame 14, a hatch-lid deck 13, a hatch lid trim 15, and a rod element 16. In this position, one straight segment of the rod element 16 operates as an axis of opening. The hatch-lid deck 13 is made from LEXAN® (a proprietary polycarbonate resin sheet material, made by the General Electric Company), preferred for its strength, resistance to cracking and scratching, and machinability. Such a deck can support substantial weight and may have a design sand-blasted onto its upper surface that can functionally provide for increased traction to someone walking on the hatch-lid deck.

Figure 2:
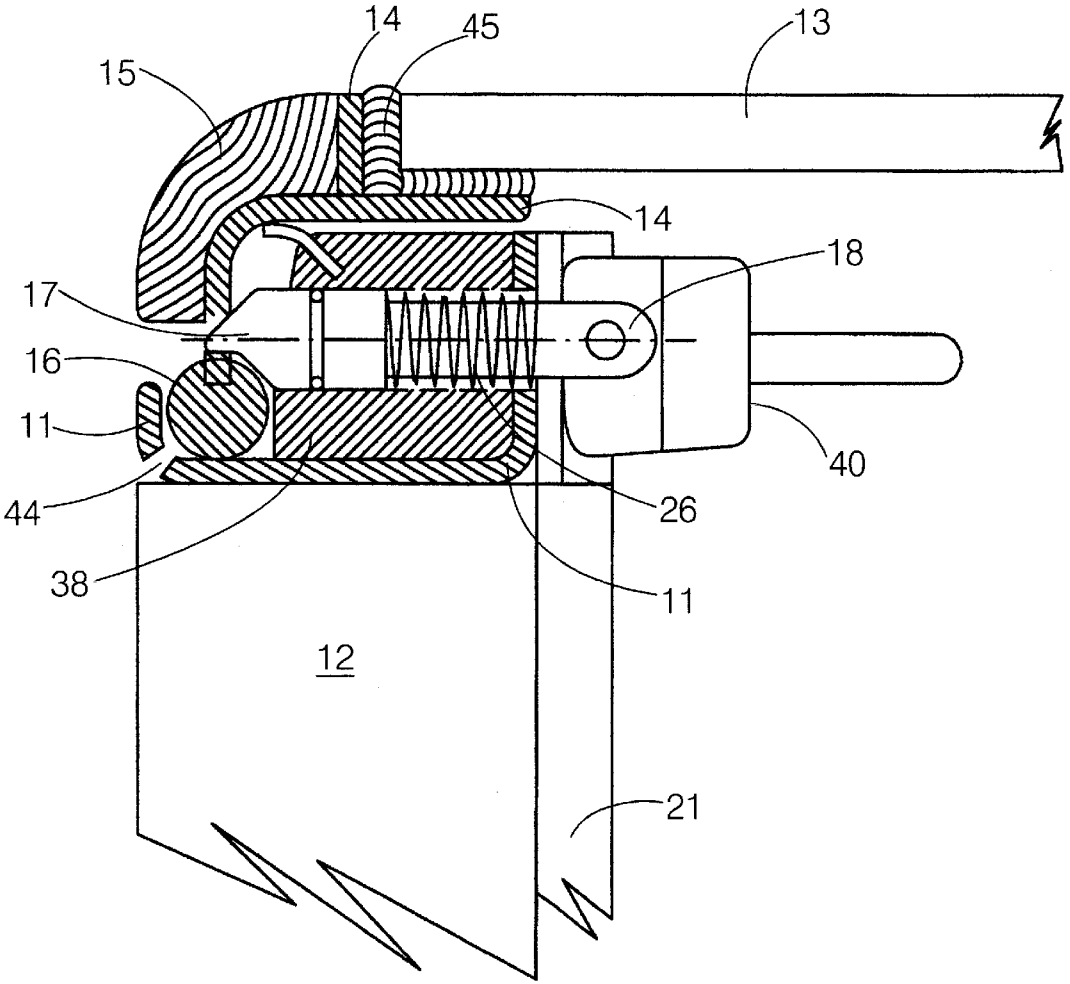
FIG. 2 is a sectional view of the Preferred Embodiment, showing the latch pin and adjoining hatch frame and base frame.

As shown in FIG. 2, the rod element 16 depends from and is attached to the hatch-lid frame 14. The hatch-lid trim 15 is fixed over the hatch-lid frame 14. The hatch-lid deck 13 is affixed with an adhesive 45 within the aperture defined by the hatch-lid frame 14. In marine applications, teak wood is often used for trimming. For the reasons of corrosion resistance and light weight, an alloy of titanium is chosen in the Preferred Embodiment for the hatch-lid frame 14. And for reasons of corrosion-resistance and economy, a stainless steel alloy is used in the Preferred Embodiment for the base frame 11.

Figure 3:
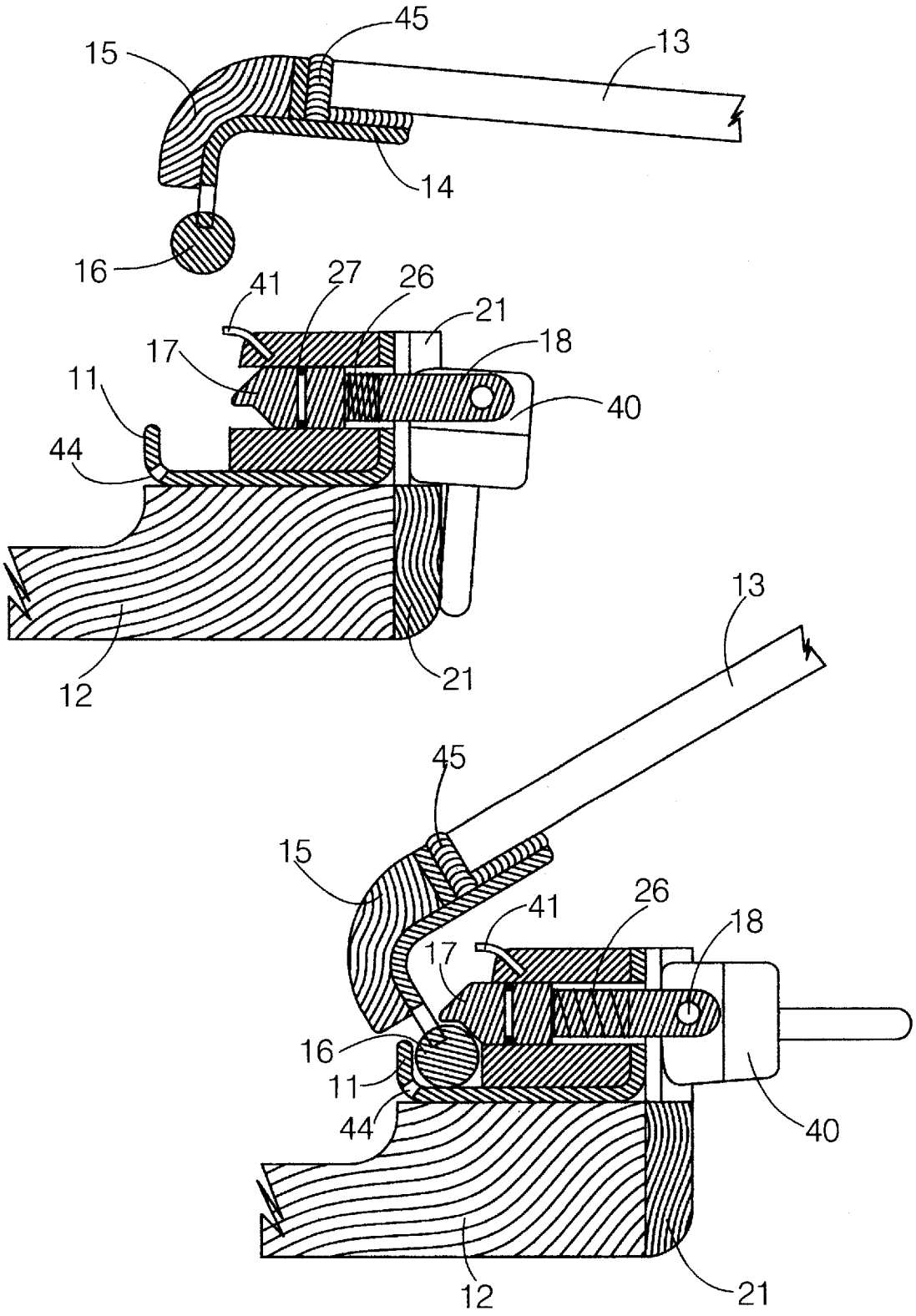
FIG. 3 is a sectional view of the Preferred Embodiment of the hatch assembly showing a side of the hatch assembly in two alternate positions: one, with the side as the pivot; and the other with the hatch open along that side.
Figure 5:
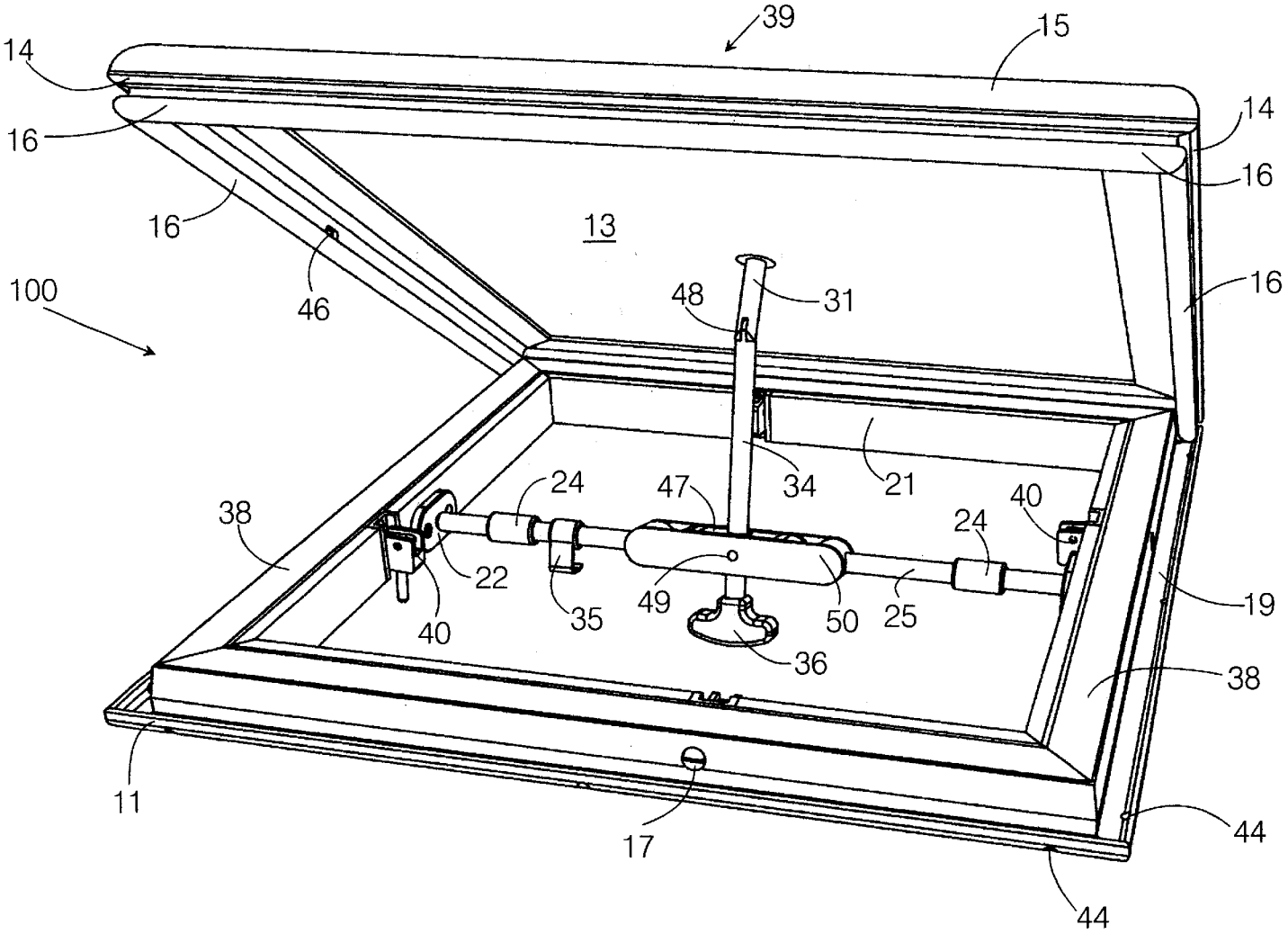
FIG. 5 is a perspective view the Preferred Embodiment of the present invention, hinged open along a different axis than that shown in FIG. 1.

As seen in FIG. 1 and FIG. 5, a cam 40 is attached to each inner side 21 of the base frame 11. Each cam 40 is pivotally connected to a latch pin 17 by a cam-pivot pin 18. As seen in FIG. 3., the latch pin 17 is inserted through the inner side 21 of the base frame 11, and a spring 26 mounted over the shaft of the latch pin 17 captures the latch pin 17 and provides outward pressure. The latch pin 17 is engaged over the rod element 16 and disengaged from it by rotating the respective cam 40 on its cam-pivot pin 18. When the small dimension of the cam 40 engages inner side 21 of the base frame 11, the latch pin 17 is fully extended, confining the straight segment of the rod element 16 which it engages within the base frame 11; when the large dimension of the cam 40 engages inner side 21 of the base frame 11, the latch pin 17 is fully retracted, and the straight segment of the rod element 16 is free and can be removed from the base frame 11. Further, although an engaged latch pin 17 confines a straight segment of the rod element 16 within the base frame 11, that straight segment of the rod element 16 is free to rotate within the base frame 11.

Four latch pins 17 are used, each one positioned on one of the straight segments of the rod element 16. To open the hatch lid 39, the axis of opening is selected by rotating the cam 40 and engaging the latch pin 17 along that the corresponding rod element 16, and oppositely rotating the cam 40 and engaging the latch pin 17 on the remaining three sides. To lock the hatch lid 39 in the closed position, a latch pin 17 on each of the remaining three sides is engaged—although the hatch lid 39 can be secured closed, though not sealed, when a latch pin 17 on each of two opposing sides is engaged. The remove the hatch lid 39 from the base frame 11, each latch pin 17 on each of the four sides is disengaged.

FIGS. 1, 2, 5 and 6, show a barrier 38 as it rests in the base frame 11. The barrier 38 is made of DELRIN® (a proprietary synthetic resinous plastic material, made by E.I. duPont de Nemours). DELRIN® is preferred for the barrier 38 as this material is weather resistant, highly corrosion resistant, and readily machinable. In addition to providing for weather resistance, this barrier 38 provides support for the latch pins 17 and cams 40. A gasket 41 runs along the upper outer edge of the barrier 38 to provide for the increased weather resistance. A plurality of drain holes 44 are disposed through the base frame 11 to facilitate the draining of water from the frames.

Figure 4:
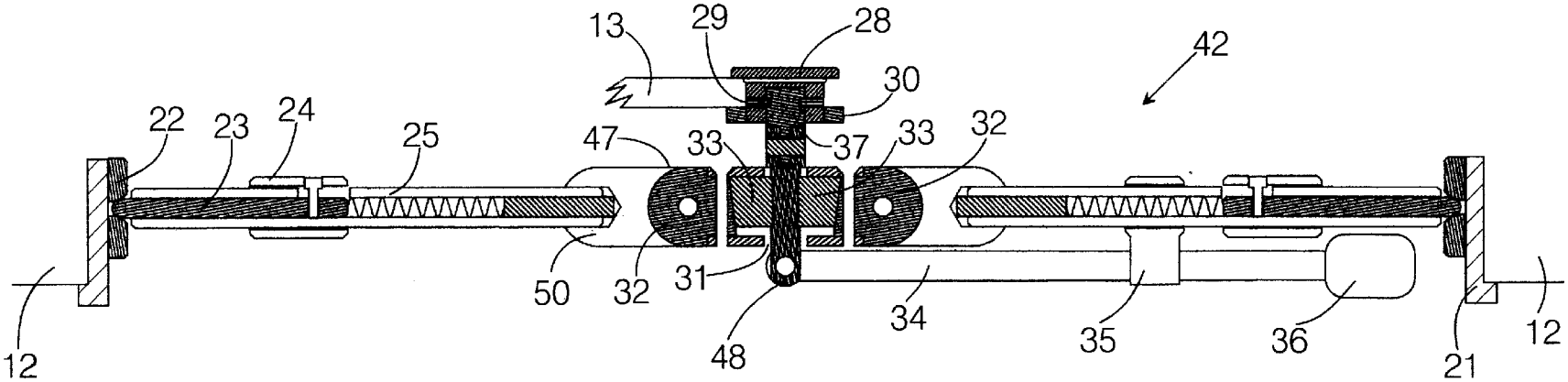
FIG. 4 is a sectional view of an embodiment of the prop assembly, showing the prop spanning an aperture and supporting a hatch-deck lid. Only a portion of the hatch-deck lid is depicted.
Figure 6:
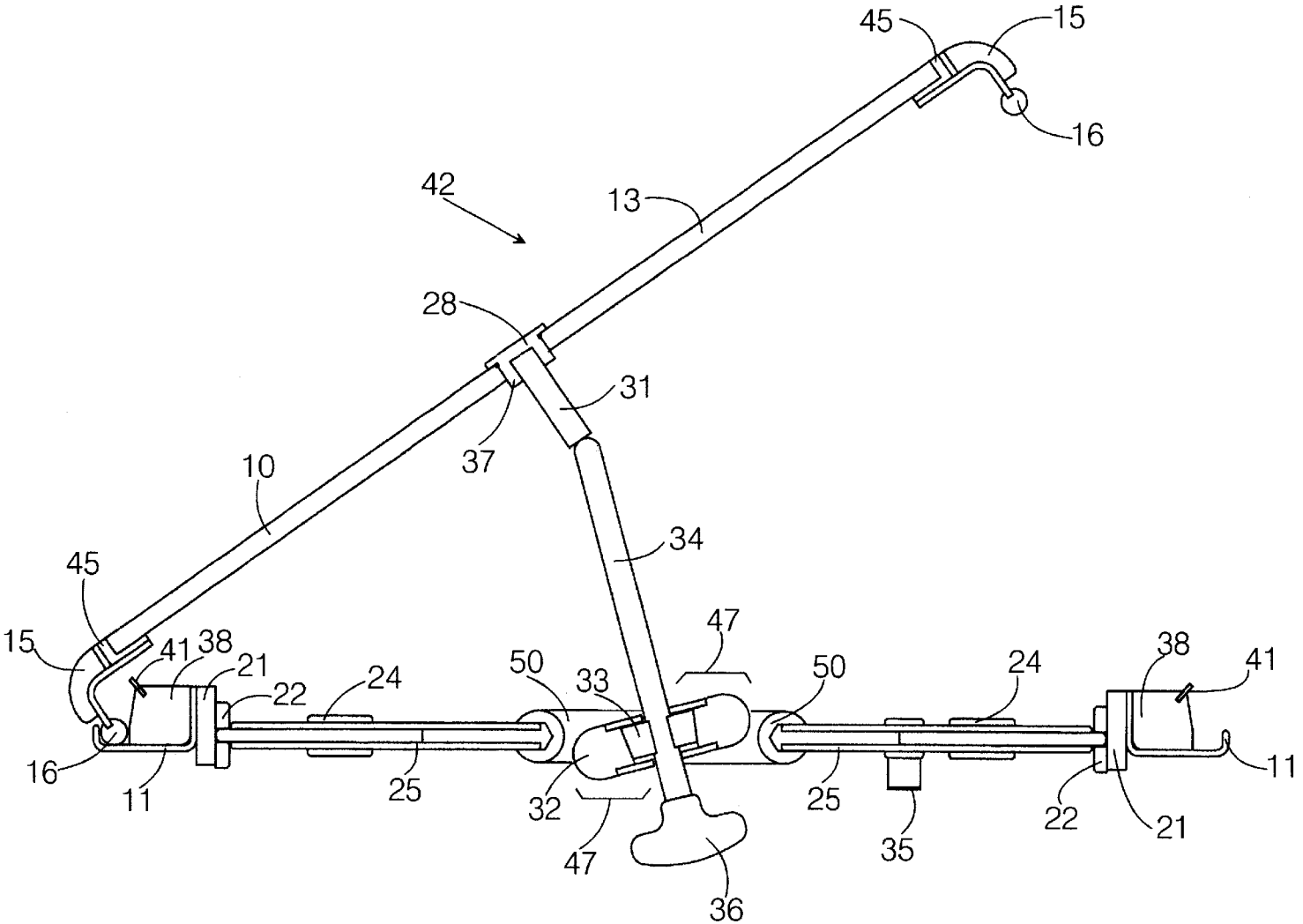
FIG. 6 shows the hatch and the prop assemblies used in conjunction with each other.

In FIGS. 4 and 6, the prop assembly 42 of the present invention is shown in cross-section. The prop assembly 42 includes a support tube 25 that spans the aperture defined by the base frame 11, and an actuation rod assembly 60 that includes an upper actuation rod 31 pivotably connected to a lower actuation rod 34 at a rod joint 48. The weight of the hatch lid 39 is supported by the actuation rod assembly 60 which is adjustably held by a pair of jam blocks 33 which are located within a jam-block housing 47. This jam-block housing 47 is shown in FIGS. 1 and 5. The jam-block housing 47 is connected to a carrier 50 that is integral with the support tube 25. This jam-block housing 47 pivots on a center-pivot pin 49 located near the middle of the longitudinal axis of the carrier 50. This center-pivot pin 49 allows the jam-block housing 47 and actuation rod assembly 60 to tilt, with the hatch-lid 39 as the hatch lid 39 is opened about any of its multiple axes.

Inside of the jam-block housing 47 are two jam blocks 33 and a pair of ramped blocks 32. The two jam blocks 33 are made of urethane, preferably having a 95A durometer value and are shaped such that the actuation rod assembly 60 can slip past them when the flat sides of the actuation rod assembly 60 are adjacent—i.e., parallel—to the interior, inward-directed faces of the jam blocks 33. The ramped blocks 32 are integral with the jam-block housing 47. In alternate embodiments the ramped blocks can be separate (yet still contained within) the jam-block housing 47. The overall shape of the ramped blocks 32 and the jam blocks 33 may vary, but the essential relationship between the ramped blocks 32 and the jam blocks 33 is that they engage each other by way of ramped faces. As downward force is increased (e.g. by someone standing on the partially open hatch-lid deck 13) along the actuation rod assembly 60, this configuration provides for in creased gripping force opposing the downward force. Consequently, other shapes for both the ramped blocks 32 and the jam blocks 33 can be used in the present invention as long as the alternate shapes have ramped interfaces configured so as to taper inward toward the actuation rod in a direction toward the handle as shown in FIGS. 4 and 6.

Referring to FIGS. 4 and 6, inside of the jam-block housing 47, on each side of the actuation rod assembly 60, one jam block 33 is positioned so that its inclined face—which, in cross-section would correspond to the hypotenuse of the triangle of the truncated right-triangle shape—abuts the inclined face of the ramped block 32.

The prop assembly 42 is designed to open the hatch lid 39 and hold it open in any of the orientations that the multi-axis hatch assembly 100 is capable of. This ability is possible because the actuation rod assembly 60, as mounted on the prop assembly 42 can swivel through 360 degrees.

The actuation rod assembly 60 has a cross-section similar to a rectangle having one pair of opposite sides being capped by arcuate curves. With reference to FIG. 4, one end of the upper actuation rod 31 is affixed to the underside of the hatch-lid deck 13 by means of an attachment bolt 28, a retaining pin 29, and an attachment nut 30; the other end of the upper actuation rod 31 is pivotably attached to the lower actuation arm 34 at the rod joint 48 (see also FIG. 5). This rod joint 48 permits the lower actuation rod 34 to be folded along the support tube 25 in a compact fashion. In addition, this rod joint 48 allows the upper actuation rod 31 to move in conjunction with the hatch-lid deck 13. At an end opposite the rod joint 48, the lower actuation rod 34 is attached to a handle 36, by which an operator turns the actuation rod 31, 34.

To move the position of the hatch lid once it is in an open position, the actuation rod assembly 60 is turned so that its flat surfaces (which run along its longitudinal axis) are transverse to the longitudinal axis of the jam-block housing 47, the actuation rod assembly 60 freely slides through the jam-block housing 47. When the actuation rod 60 is turned 90 degrees (a quarter turn), the arcuately curved sides effectively increase the diameter of the actuation rod assembly 60 and the actuation rod contacts the pair of jam blocks 33; each one of the pair residing in the jam-block housing 47 on either side of the actuation rod assembly 60. The jam blocks 33 are on inclined planes of the inner faces of the ramped blocks 32, the jam blocks 33 lock the actuation rod subassembly when forced in a downward direction by the weight of the hatch lid 39. The inclined planes of the ramped blocks 32 have a rough finish so that the movement of the jam blocks 33 is restrained when the handle 36 is turned to its closed position. In the Preferred Embodiment, all elements of the prop assembly 42 are preferably constructed from stainless steel; the handle 36 is made from teak wood; the jam blocks 33 are made from urethane.

To unlock the actuation rod assembly 60 (from holding the hatch lid 39), the actuation rod assembly 60 is rotated 90 degrees, by turning the handle 36, returning the flat sides of the actuation rod assembly 60 to their position in which they are parallel to the interior faces of the jam blocks 33. In this position the jam blocks 33 are released from contact with the ramped blocks 32. When the hatch lid 39 is closed, the lower actuation rod 34 can be stored in the storage hook 35. The handle 36 is T-shaped so that the operator can determine the orientation of the actuation rod assembly 60. The prop assembly 42 can be disconnected from the base member 12 by retracting either one of the mounting pins 23 from its respective mounting fixture 22 affixed to the inner side 21 or the base frame 11. This is done by pulling either mounting pin collar 24 towards the center of the support tube 25. This is a safety feature which allows a person ingress or egress through the hatch in an emergency situation.

What is claimed is:

1. A hatch apparatus for sealing an opening in a surface enclosure, said apparatus comprising:

a hatch lid having a plurality of straight, non-collinear lid hinge segments forming a perimeter;

a frame having a plurality of straight, non-collinear frame hinge segments, said frame defining an aperture that is selectively openable and sealable by said lid, said plurality of frame hinge segments being equal in number to said plurality of lid hinge segments; and an adjustable prop assembly disposed across said aperture;

wherein said frame is mountable on said enclosure surface;

wherein said lid when opened is supportable by said prop assembly throughout a range of dihedral angles formable between said lid and said frame, and wherein a hinge axis is established by coupling a particular one of said frame hinge segments with a corresponding one of said lid hinge segments.

2. The apparatus of claim 1, said frame further comprising:

a plurality of rod elements, each of said rod elements depending from a respective one of said lid hinge segments;

an exterior groove that extends along each frame-hinge segments and is adaptable to receive a respective one of said rod elements;

a plurality of latch pins, each one of said latch pins disposed along one of said frame-hinge segments interior to said frame and selectively engageable and disengageable;

a plurality of frame openings through said frame, each one of said frame openings arranged on one of said frame-hinge segments so as to receive a respective one of said latch pins; and a barrier fitted within said exterior groove, said barrier having a plurality of barrier openings, each of one of said barrier openings being paired with and coaxial to one of said frame openings such that one of said latch pins can slide through both so as to restrainably engage said respective one of said rod elements in said exterior groove.

3. A hatch apparatus, said apparatus comprising:

a hatch lid comprising a lid frame defining a lid aperture and a lid deck having a generally flat shape, said lid deck fittedly disposed within said aperture of said lid frame;

a base frame disposed underneath said hatch lid, said base frame being concentric with, and generally the same shape as said top frame, said base frame having an exterior groove around its perimeter, said hatch base frame further defining a second aperture substantially equal in size to and substantially concentric with said first aperture;

a rod element having a segmented elongate rod shape containing a plurality of straight, non-collinear segments, said rod element depending from said lid frame, wherein said rod element fits within said groove of said base frame while said hatch lid is in a closed position, and a straight segment of said rod element fits within a corresponding straight groove segment of said base frame when said hatch lid is in an open position; and a plurality of latch pins disposed along and interior to said top frame in such manner that by selectively engaging a first latch pin and disengaging a remainder of latch pins, said first latch pin is caused to slide through an aperture in said base frame and through a corresponding aperture in said top frame, grasping a straight segment of said rod element resting in a corresponding groove segment of said base frame, thereby preventing displacement of said hatch top relative to said base frame along said straight rod segment;

wherein by the application of force to said hatch lid, said hatch lid is pushed outward, rotating along an axis of rotation defined by said straight segment of said rod element and said hatch lid is opened selectively about any one of a plurality of axes.

4. The apparatus of claim 3 wherein said rod element is attached to said lid frame.

5. The apparatus of claim 3 wherein said rod element is attached to said base frame.

6. The apparatus of claim 3 wherein said hatch apparatus has four axes of rotation.

7. The apparatus of claim 3, further comprising:

a prop assembly having a support tube, an actuation rod assembly, and a means for adjustable engagement, wherein said support tube of said prop assembly spans said aperture of said base frame; wherein said actuation rod assembly has a first end and a second end and is connected at said first end to said support tube and at said second end to said hatch lid, and wherein, said lid frame coupled with said hatch lid is supportable by said prop assembly at a point of contact with said hatch lid;

wherein, by selectively engaging a first latch pin and causing said first latch pin to slide through a pin aperture in said base frame and through a corresponding pin aperture in said lid frame, and by disengaging a remainder of latch pins, said first latch pin restrains a straight segment of said rod element resting in a corresponding groove segment of said base frame, thereby preventing displacement of said hatch lid relative to said base frame along said straight rod segment; and wherein said hatch lid is selectively openable about any one of said axes by application of outward force to said actuation rod assembly, pivoting said hatch lid about said one of said axes.

8. The apparatus of claim 7 wherein said rod element is attached to said base frame.

9. The apparatus of claim 8 wherein said hatch apparatus has a hexagonal shape and said apparatus has six axes of rotation.

10. The apparatus of claim 7 wherein said rod element is attached to said lid frame.

11. The apparatus of claim 7 wherein said hatch apparatus has a rectangular shape and said apparatus has four axes of rotation.

12. A hatch apparatus comprising:

a lid frame that includes a lid aperture and a plurality of pin apertures disposed therethrough;

a lid deck having a generally flat shape fittedly disposed within said lid aperture of said lid frame to form a lid;

a base frame, said base frame being concentric with and generally the same shape as said lid frame, said base frame having an exterior groove around its perimeter, said base frame further including an aperture of substantially the same size and concentric with said lid aperture, said base frame further having a plurality of pin apertures disposed therethrough, corresponding in number to and coaxial with said plurality of pin apertures disposed through said lid frame;

a rod element having a segmented, elongate rod shape containing a plurality of straight segments extending around the perimeter of said base frame, said rod element being attached to said lid frame, wherein said rod element fits within said groove of said base frame when said hatch apparatus is closed, and a straight segment of said rod element fits within a corresponding straight groove segment of said base frame; and, a plurality of latch pins axially slidably disposed on the interior of said lid frame, and transverse to said top and base frames, said latch pins coaxial with said apertures disposed on said base frame and with said apertures disposed on said lid frame;

wherein by selectively engaging one of said latch pins so as to slide through a respective one of said pin apertures in said base frame and through a respectively corresponding one of said pin apertures in said lid frame, said first latch pin restrains a straight segment of said rod element resting in a corresponding groove segment of said base frame, thereby preventing displacement of said hatch lid relative to said base frame along said straight rod segment: and wherein said lid is selectively openable about any one of said pivot axes by the application of outward force to said lid, said lid frame thereby rotating along an axis of rotation defined by said straight segment of said rod element.

13. The apparatus of claim 12 wherein said rod element has four straight segments.

14. A multiple-axis hatch apparatus comprising:

a hatch lid having a lid frame;

a hatch base having a hatch-base frame, said hatch-base frame defining a hatch aperture and having a shape that includes a plurality of sides, said hatch-base frame being adaptable to receive said lid frame, wherein said hatch-base frame has a pivot axis along each side and said lid frame is selectively pivotable about any one said pivot axis; and an adjustable prop means that spans said hatch aperture.

15. The apparatus of claim 14 further comprising a plurality of straight rod-elements attached to said lid frame, each of said rod-elements functioning selectively as said pivot axis.

16. The apparatus of claim 15, wherein said shape of said apparatus is rectangular and said plurality of rod-elements includes four said rod-elements.

17. The apparatus of claim 15 wherein said shape of said apparatus is hexagonal and said plurality of rod-elements includes six said rod-elements.

18. The apparatus of claim 15 wherein said adjustable prop means is an adjustable prop assembly comprising:

a support tube adapted to span said aperture defined by said base frame, a support tube having a carrier disposed on a portion of said support tube, said support tube having an engagement means pivotably disposed within said carrier; and an actuation-rod assembly having a first end and a second end, said first end supporting said hatch-lid, said actuation rod being disposed through said engagement means of said support tube.

19. The apparatus of claim 18 wherein said actuation rod assembly comprises:

an upper actuation-rod having a first end and an upper-rod pivot-end, said first end supporting said lid; and a lower actuation rod pivotably connected to said upper-rod pivot-end of said upper actuation-rod.

20. The apparatus of claim 19 wherein said engagement means comprise:

a jam-block housing having a longitudinal axis, said jam-block housing being pivotably disposed within said carrier, said jam-block housing having a first aperture disposed on a first surface, and a second aperture disposed on a second surface that is parallel to said first surface, said first aperture defining a plane section that is both parallel to said longitudinal axis and intersects a line that is perpendicular to a mid-point of said longitudinal axis, said second aperture defining a plane section that is both parallel to said longitudinal axis and intersects said line, said jam-block housing having a cavity disposed therewithin;

a pair of ramped-blocks disposed within said cavity, one of said pair of ramped-blocks being disposed on an opposing side of said cavity with respect to said line, each of said pair of ramped-blocks having a ramped-block ramped-surface; and a pair of jam-blocks disposed within said cavity, one of said pair of jam-blocks being disposed on an opposing side of said cavity with respect to said perpendicular-line, each of said pair of jam-blocks having a jam-block inclined-surface, each of said jam-blocks having an actuation-rod contact surface, wherein each of said jam-blocks rests on its jam-block inclined-face on a ramped block ramped-face;

wherein, by a turning movement of said actuation-rod subassembly, each of said jam-blocks is moved away from said line by a change in diameter of said lower actuation-rod, wherein said actuation-rod contact-surface of said jam blocks grips said lower actuation-rod, preventing said actuation-rod assembly from displacement along a perpendicular line.

21. The apparatus of claim 20 wherein said jam-blocks are made of urethane.

22. A hatch apparatus for selectively opening and closing an aperture on an enclosure surface, said apparatus comprising:

a first element having a plurality of straight, non-collinear first sides forming a perimeter about said first element;

a second element having a plurality of straight, non-collinear second sides, said plurality of second sides being equal in number and corresponding in size to said plurality of first sides, wherein said second element defines a hatch aperture that is selectively openable and closable by said first element; and an adjustable prop assembly that is mounted in said second element and spans said hatch aperture.

23. The apparatus of claim 22 further comprising a hinge mechanism, wherein any one or more of said first sides are selectively couplable to corresponding ones of said second sides by said hinge mechanism, wherein said hinge mechanism includes a plurality of hinge assemblies, each assembly having a hinge rod, a latch pin, and a rod seat, wherein said hinge rod is seatable in said rod seat and said latch pin is mounted on said apparatus so as to selectively and releasably engage said hinge rod in said rod seat.

24. The apparatus of claim 23, wherein said hinge mechanism includes a hinge element that is a continuous rod that extends about all sides of said first element, a portion of said continuous rod that extends along any one of said sides being said hinge rod, wherein said plurality of hinge assemblies includes one said hinge rod on each one of said sides of said first element, one said rod seat on each one of said sides of said second element, and one said latch pin mounted on an interior surface of each one of said second sides.

25. The apparatus of claim 24, wherein said hinge mechanism includes a plurality of latch pin retainers, said plurality of latch pin retainers corresponding in number to said plurality of latch pins, each latch pin retainer being disposed on each one of said sides of said second element and aligned so as to receive said latch pin when said latch pin is engaged.

26. The apparatus of claim 25, said hinge mechanism further including a barrier fitted within said rod seat, said barrier having a plurality of barrier openings, each one of said barrier openings being paired with and coaxial to a corresponding one of said latch pin retainers such that a corresponding one of said latch pins is engageable through said one of said barrier openings and said corresponding one of said latch pin retainers.

27. The apparatus of claim 23, wherein said first element is detachable from said second element by disengaging each of said latch pins.

28. The apparatus of claim 23, wherein said first element is sealable with said second element by engaging two or more of said latch pins.

29. The apparatus of claim 23 wherein said first element is a hatch lid and said second element is a hatch frame that is disposed over said aperture in said enclosure surface; and wherein said hatch lid is openable by pivoting one of said sides of said hatch lid about a corresponding one of said hinge assemblies and is supportable by said prop assembly throughout a range of dihedral angles formable between said hatch lid and said hatch frame.

30. The apparatus of claim 29, said adjustable prop assembly including:

a support tube adapted to span said aperture defined by said base frame, an engagement assembly including a carrier disposed on a portion of said support tube and an engagement means pivotably disposed within said carrier;

an actuation-rod assembly having an upper actuation rod with a first end and a lower actuation rod with a second end, said first end supporting said hatch lid and said second end extending through said engagement means;

wherein said lower actuation rod and said upper actuation rod are pivotably linked to one another;

wherein said lower actuation rod has an oblong-shaped perimeter providing an engagement orientation with a greater dimension; and wherein said carrier has a longitudinal axis and said lower actuation rod is engageable by said engagement means when said rod is rotated so as to align said engagement orientation with said longitudinal axis of said carrier.

31. The apparatus of claim 22, wherein said hinge mechanism is actuatable by means that include manual, mechanical, electrical-mechanical, hydraulic, and pneumatic actuation means.

* * * * *